United States Patent [19]

Bankar

[11] Patent Number: 5,032,333

[45] Date of Patent: Jul. 16, 1991

[54] ONE-LINE INTERLACING OF BULKED CONTINUOUS FILAMENT YARNS AND LOW-MELTING BINDER FIBERS

[75] Inventor: Vilas G. Bankar, Seaford, Del.

[73] Assignee: E. I. Du Pont de Nemours and Company, Wilmington, Del.

[21] Appl. No.: 485,590

[22] Filed: Feb. 27, 1990

[51] Int. Cl.[5] ..... D02G 3/24

[52] U.S. Cl. ..... 264/103; 264/210.8; 264/211.15; 264/211.17; 264/168; 57/245; 57/350; 57/908

[58] Field of Search ..... 57/244, 245, 246, 350, 57/908; 264/103, 210.8, 211.15, 211.17, 168

[56] References Cited

U.S. PATENT DOCUMENTS

| | | | |
|---|---|---|---|
| 4,304,092 | 12/1981 | Bridges et al. | 57/908 |
| 4,612,150 | 9/1986 | De Howitt | 264/103 |

FOREIGN PATENT DOCUMENTS

| | | | |
|---|---|---|---|
| 50-154549 | 12/1975 | Japan | 57/245 |
| WO8803969 | 6/1988 | PCT Int'l Appl. . | |
| 2205116A | 11/1988 | United Kingdom . | |

*Primary Examiner*—Hubert C. Lorin

[57] ABSTRACT

This invention relates to a process for combining a low melting binder fiber with a continuous filament base yarn to form a composite yarn having good bulk and a high level of interlace. More particularly, the process involves bulking a continuous filament yarn, combining it with the low-melting binder fiber, interlacing the combined yarn, and then fixing the interlace.

4 Claims, 3 Drawing Sheets

ONE-LINE INTERLACING OF BULKED CONTINUOUS FILAMENT YARNS AND LOW-MELTING BINDER FIBERS

TECHNICAL FIELD

This invention relates to a process for producing bulked, interlaced yarns containing low-melting binder fibers. More specifically, the invention pertains to a method for introducing low-melting filaments into a high-speed running threadline of bulked continuous filament yarn and interlacing the two components to achieve a high degree of intermingling without a tight nodal structure or loopiness.

BACKGROUND OF THE INVENTION

The use of heat-activated binder fibers in carpet yarns to improve retention of tuft identity, resulting in increased wear resistance and carpet life, is disclosed in the published patent applications Hackler, PCT-WO 88/03969 and Watt & Fowler GB 2205116-A. The referenced published applications teach that bulked continuous filament (BCF) yarns containing low-melting binder filament yarns may be produced using conventional manufacturing methods but do not disclose or give examples as to where in the process or how the binder filament is incorporated into and intermingled with the base continuous filament yarn.

Methods suggested by the prior art have various shortcomings. The binder and BCF yarns may be ply-twisted together in the carpet mill prior to tufting; however this will lead to binding of individual plies rather than binding the filaments within each tuft. An additional disadvantage of using this method is that the fiber producer is unable to ensure the quality of tuft bonding in the final carpet since the process for incorporating the binder filaments in the yarn is carried out in the carpet mill. A further drawback of this method is that when the binder filaments are twisted together with the BCF yarn, the binder filaments are essentially wrapped around the outside of the BCF yarn bundle. When these yarns are heatset with moist heat as in a Superba heat-setting apparatus (where typically 6–24 twisted ends are heat-set simultaneously on a moving belt) or in an autoclave (where yarn skeins are used), the ends may stick together to an unacceptable degree. Such sticking can be a particular problem for a Superba process as the line has to be shut down whenever the bundles are stuck together.

The binder filaments may also be added prior to drawing the base continuous yarn and the two yarns co-bulked and interlaced in a process similar to that disclosed in De Howitt, U.S. Pat. No. 4,612,150. However, in this case the binder fiber melts on the hot rolls, and the process becomes inoperable. Although the temperature of the hot rolls may be reduced to avoid melting of the binder fiber, in such event inadequate carpet bulk is obtained.

Another option is to add the binder fiber after the heated draw rolls but before the bulking/interlacing jet. However, residual heat in the base fiber coming off the heated draw rolls and the heat in the bulking fluid used in the jet may be sufficient to soften and melt the binder fiber and cause it to break intermittently along the length of the base continuous filament yarn. The broken filaments cause severe housekeeping problems in the areas of both the BCF machine and the twisting equipment. Again, the bulking temperature may be reduced to eliminate breaks, but this tends to result in insufficient bulk. Yet another option is to add the binder fibers to the continuous filament yarn after it passes through the bulking/interlacing jet. However, since the BCF yarn is well-interlaced at this point, it is not possible to achieve optimum intermingling of the BCF and binder filaments. This results in filament breaks in downstream mill operations such as twisting, knit-de-knit processing, or tufting.

The process of the current invention overcomes the above-mentioned problems by incorporating binder fibers into a base continuous filament yarn in a manner which maximizes the bulk and degree of intermingling of the two components and eliminates filament breaks in the low-melting component. A further advantage of the present invention is that the process may be run at high speeds, in excess of 2000 yd/minute (1829 m/minute) with excellent bulk and interlace in the final two-component yarn.

SUMMARY OF THE INVENTION

The process of the present invention involves producing a composite yarn having a high level of interlace and bulk and comprises the steps of:

a) bulking a continuous filament yarn;
b) combining a low-melting binder yarn with the bulked yarn to form a composite yarn;
c) interlacing the composite yarn at a temperature below the melting point of the binder yarn; and
d) fixing the inter)ace of the composite yarn.

Examples of suitable continuous filament base yarns for use in this process are those spun from polymers such as nylon 6, nylon 6,6, polyproplene, and polyester. The low melting binder yarns are typically made using random copolymers of the polymer type found in the base yarns and are chosen such that the binder fibers melt at temperatures used for heatsetting carpet yarns by conventional techniques. Such heat-setting temperatures are typically about 130°–140° C. for Superba steam heat-setting equipment and about 190°–205° C. for Suessen dry heat-setting.

DETAILED DESCRIPTION OF THE PREFERRED EMBODIMENT

Figure 1:
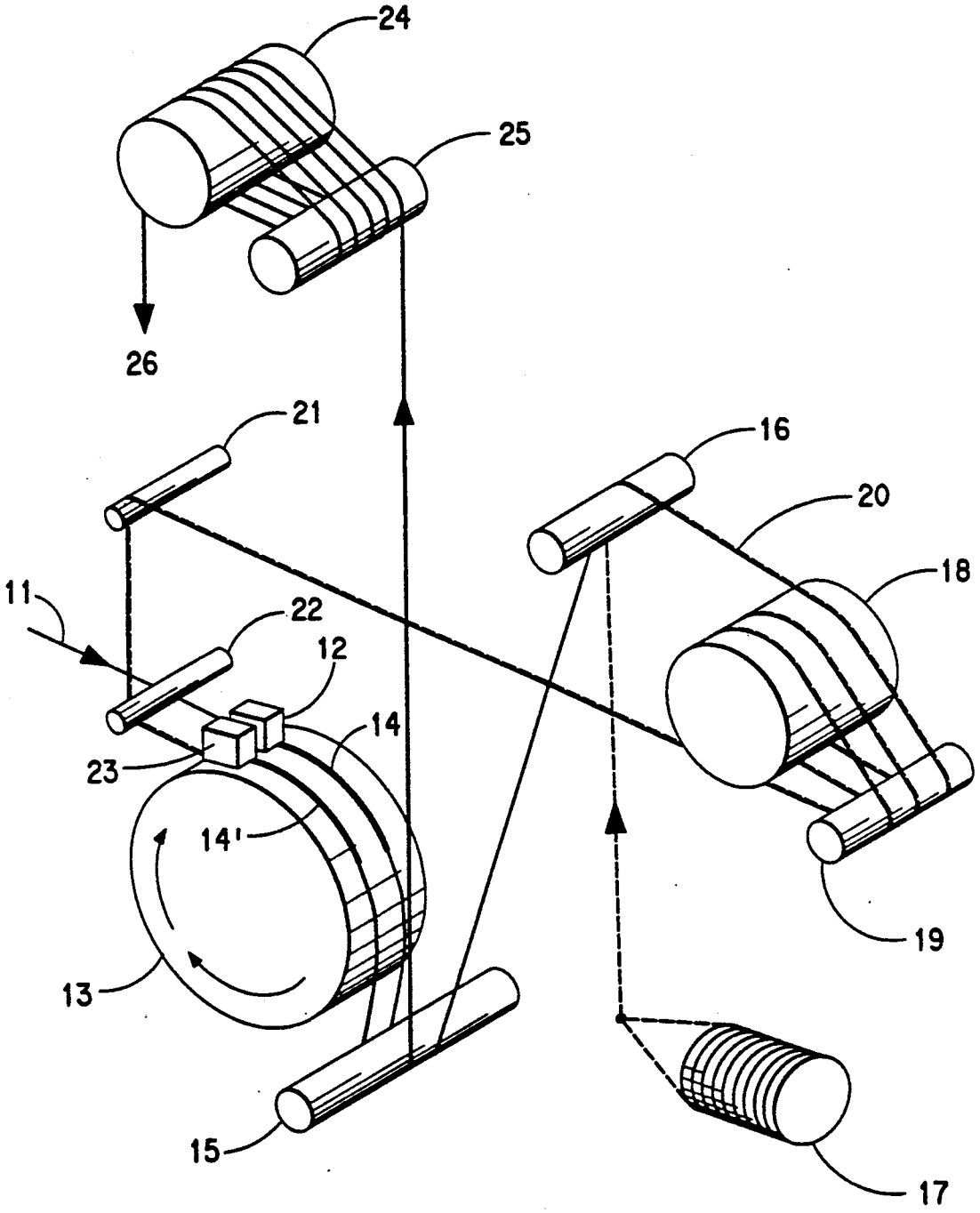
FIG. 1 is a schematic of a preferred process of this invention.

The bulking step of this process involves crimping or otherwise adding texture to the filaments of the continuous yarn bundle in order to form a bulked yarn having little or no interlace. Bulking processes of this general type are disclosed in Breen and Lauterbach, U.S. Pat. No. 3,854,177, whose disclosure is incorporated herein by reference. Interlace is to be minimized in order to more effectively combine and then, at a later stage, interlace together the filaments of the continuous base yarn with those of the low-melting binder fiber. The bulking step is most effectively performed immediately following drawing of the freshly-spun continuous filament yarn. When a hot-draw process is used, the yarn will be heated during drawing, and the elevated temperature will assist in imparting adequate bulk to the fiber. It has been found that an effective amount of bulk can be added to the yarn with little or no interlace by impinging the yarn with a fluid stream within a single-impingement bulking jet. A particularly useful jet of this type is the dual-impingement jet described in Coon, U.S. Pat. No. 3,525,134, the disclosure of which is herein incorporated by reference, where one of the fluid orifices has been plugged, rendering it inoperative. When such a jet is used, the bulk developed in the jet should be set as further described below.

The bulked continuous filament base yarn is then combined with the low-melting binder fiber using conventional methods, and the composite yarn is then interlaced. As used herein the term interlacing refers to extensive entanglement or comingling of the filaments which make up the yarn bundle. Accordingly, the interlacing step of this invention should effectively comingle the filaments of the bulked base yarn with those of the low-melting binder fiber. This can be accomplished using conventional interlacing methods, such as impinging the yarn with multiple fluid streams in a multiple-impingement jet. The dual-impingement jets described in Coon (without the plugging modification described for the bulking step above) are particularly useful.

It is important that the interlace in the composite yarn be fixed. The term "fixing" as used herein refers to the process of reducing the tension on the freshly interlaced composite yarn to a virtually tension-less state or otherwise establishing the degree of interlace in the composite yarn so that it is not later pulled out when the yarn is placed under normal tension. One method for fixing the interlace is to forward the interlaced composite yarn onto a movable surface such as a rotating drum where the yarn is allowed to rest in a substantially tension-free state in the form of a bulky "caterpillar", thereby fixing the interlace and setting the bulk. If interlaced at elevated temperatures, the yarn can also be cooled during this step. The surface of the drum may consist of a perforated plate or mesh screen, and a partial vacuum can be applied through the plate or screen to hold the yarn to the surface and provide for rapid cooling.

Referring to FIG. 1 continuous filament base yarn 11 is spun, drawn, and heated using methods well known in the art and forwarded while still in a heated condition into a single-impingement bulking jet 12 where it is treated with a single hot fluid stream having sufficient temperature and pressure so as to crimp the yarn without significant interlacing. The crimped yarn exits the jet 12 and impinges upon a drum 13 which is rotating in the direction shown by the arrow. The drum has a perforated surface (not shown) such as a screen on which the yarn cools to set the crimp. The jet to screen clearance is in the range of 0.045±0.01 in. (0.11±0.025 cm). A partial vacuum may also be applied to the yarn to hold it to the perforated surface and help cool the yarn. While on the drum the yarn is in the form of a bulky caterpillar designated by the bold line 14. Preferably, a water mist quench (not shown) is applied to the caterpillar while it is on the drum to further help cool the yarn. From the drum, the threadline passes under stationary guide pin 15 and over another stationary guide pin 16, where the low-melting binder yarn 17 is added to the threadline.

The combined yarn 20 then passes around a motor driven auxiliary roll 18 and associated separator roll 19 in several wraps which provides the same speed and tension for both the base yarn and the low-melting binder filaments prior to interlacing so that the resulting interlaced yarn is smooth in appearance without any puckering. The speed of the auxiliary roll 18 is adjusted to maintain the caterpillar 14 at the desired length to adequately set the bulk.

The combined yarn 20 passes over a pair of guide pins 21 and 22 which can be stationary pins or more preferably, rotating pins, and is forwarded into a dual or multiple-impingement jet 23 where it is treated with multiple fluid streams which are oriented in such a manner and of sufficient temperature and pressure so as to effectively interlace the filaments. In contrast to the single impingement jet which crimps or bulks the continuous filament yarn, yet does not significantly interlace it, impingement by two (or more) fluid streams in the dual (or multiple) impingement jet causes substantial filament intermingling and entanglement, resulting in the desired high level of interlace.

In order to avoid filament breaks, the temperature of the fluid streams in the jet 23 should be such that the composite yarn is not heated to a temperature above the softening point of the low-melting binder filaments. The entangled composite yarn exits the jet 23 and the interlace is fixed by impinging the yarn at low tension against a moving, perforated surface such as that of rotating screened drum 13 to form a second caterpillar 14'. A partial vacuum may also be applied to this caterpillar to hold it to the surface of the drum and assist in cooling. As with the bulked caterpillar 14, a mist quench may also be used for cooling. Although it is preferred to interlace the combined yarn using the same chest and drum as used in the original bulking step, alternatively a second chest and drum may be used for this purpose.

When using an interlace jet of the type described in Coon, interlacing is inadequate if the dual impingement jet 23 is replaced with a single impingement jet or if drum 13 or some other suitable means is not used to fix the interlace. From the drum, the yarn which is now interlaced (i.e. possesses a high degree of filament entanglement) as well as bulked passes under guide pin 15 to the take-up roll 24 and its associated separator roll 25, the speed of which controls the length of the caterpillar 14', and then to wind-up 26 (not shown) where it is wound in the desired package configuration.

Composite yarns made by this process exhibit good bulk and interlace and can be heat-set in Superba (or other types of) moist heat-setting equipment without an unacceptable number of line stoppages caused by filaments sticking to one another as described in the Background section above. When tufted into carpets following heat-setting, the carpets exhibit excellent tuft tip definition and good wear retention.

TEST METHODS

The degree of interlacing in the composite binder/-base filament yarns described below was determined using the APDC method described in Hitt, U.S. Pat. No. 3,290,932. The specific test conditions used were 30±5 g yarn tension, 318 cm/min yarn speed, and 80±5 g tripping force. Both melting point and softening point were determined using Differential Scanning Calorimetry.

Unless otherwise indicated, all percentages are by weight.

EXAMPLE 1

This example demonstrates a process according to the current invention. Polyhexamethylene adipamide having a relative viscosity of 62 were melt spun (35 lb/hr, 80 filaments, trilobal cross-section) at 290° C. into a quench chimney where cooling air at 50° F. (10° C.) and 300 $ft^3$/min (8.49 $m^3$/min) was blown past the extruded filaments. The filaments were pulled through the quench zone and over a lubricating finish roll by means of a feed roll rotating at 761 yd/min (696 m/min). The filaments were drawn at a 3.0 draw ratio on draw rolls heated to 215° C. which were rotating at 2283 yd/min (2088 m/min) and enclosed in a hot chest, and then forwarded into a single-impingement jet which is similar to the dual-impingement jet described in Coon, U.S. Pat. No. 3,525,134 except that one of the air orifices was plugged, rendering it inoperation. The yarn was subjected to the bulking action of hot air at 225° C. and a pressure of 110±5 psi in the single-impingement jet and exited the jet to impinge upon a 15 inch (38 cm) screened drum rotating at 60 rpm. To aid in the cooling and to obtain a stable caterpillar, a vacuum of approximately 15 inches of water (3.74 kPa) was pulled on the drum and a room-temperature water mist quench was applied to the caterpillar on the drum. The bulked yarn was then combined with a binder filament yarn (100 denier (111 dtex), 34 filaments) of a random copolymer of 36% nylon 6 and 64% nylon 6,6 (m.p. 201° C. in air and softening point of about 184° C.) and the combined yarns were forwarded around an auxiliary roll which was rotating at 2045 yd/min (1870 m/min) and over rotating guide pins into a dual-impingement bulking jet of the type disclosed in Coon in which the yarns were interlaced and further bulked using hot air at 180° C. and a pressure of 110±5 psi. The combined intermingled yarn exited the jet and impinged upon the rotating screen drum as described above to form a tension-free second caterpillar wherein the interlace was fixed and the yarn was cooled. It was then pulled around a stationary pin by a take-up roll rotating at a surface speed of 2015 yd/min (1843 m/min) and then wound up to form packages. The resulting yarn had a nominal 1325 denier (1472 dtex) and a high degree of interlace and bulk with an APDC value of 5.3 cm.

COMPARATIVE EXAMPLE A

Figure 2:
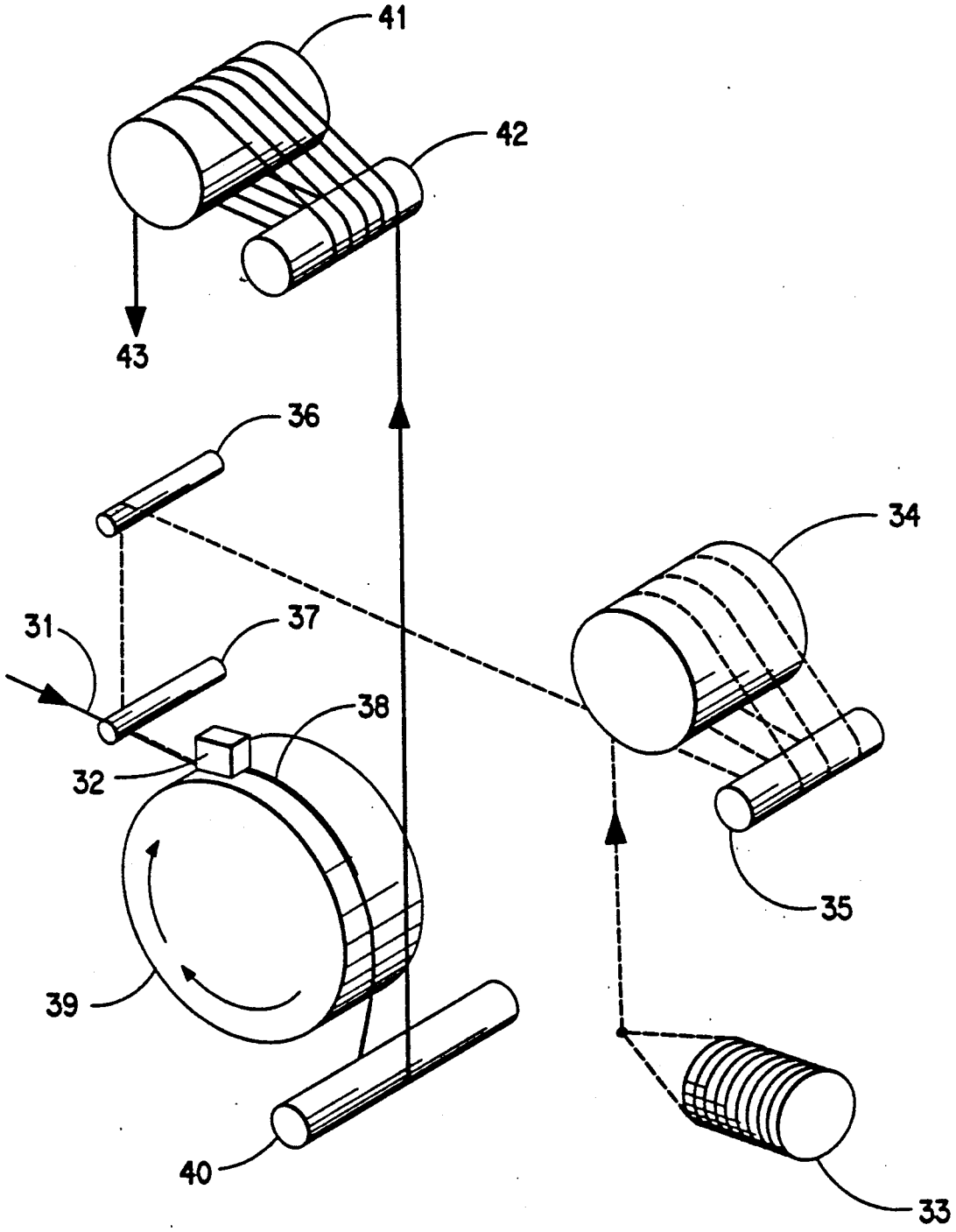
FIG. 2 is a schematic of a process in which the continuous filament base fiber and the low-melting binder filaments are co-bulked and interlaced as in a conventional process.

This example describes a process, shown schematically in FIG. 2, in which the base yarn 31 and the binder filaments 33 are co-bulked and intermingled in a single step in a dual-impingement jet 32 to demonstrate the disadvantages of such an approach versus the current invention. The process conditions were identical to those used above except that the single-impingement jet was eliminated. The random copolymer binder yarn 33 was run over and wrapped around the auxillary roll 34 and its associated separator roll 35 to ensure constant speed, then combined with the base nylon 6,6 continuous filament yarn 31 as it exited the hot chest, but before entering the dual-impingement jet 32. The combined yarn was bulked and intermingled in the dual-impingement jet by hot air at 225° C. Exiting the jet in the form of caterpillar 38, the yarn was cooled and the crimp set while on rotating screened drum 39 before passing over pin 40 to take-up rolls 41 and 42 which led to wind-up 43 (not shown). Due to the low melting point (201° C. in air), the binder filaments became tacky and broke during bulking. The broken ends were visible on the package and in photographs taken of the yarn after bulking. The bulked yarn had an APDC value of 2.2 cm, which would normally be indicative of a high level of interlace; however in this instance examination of the yarn indicated that the low APDC value was not related to a high interlace level, but rather was due to fusion of the filaments by the melted binder filaments.

COMPARATIVE EXAMPLE B

Figure 3:
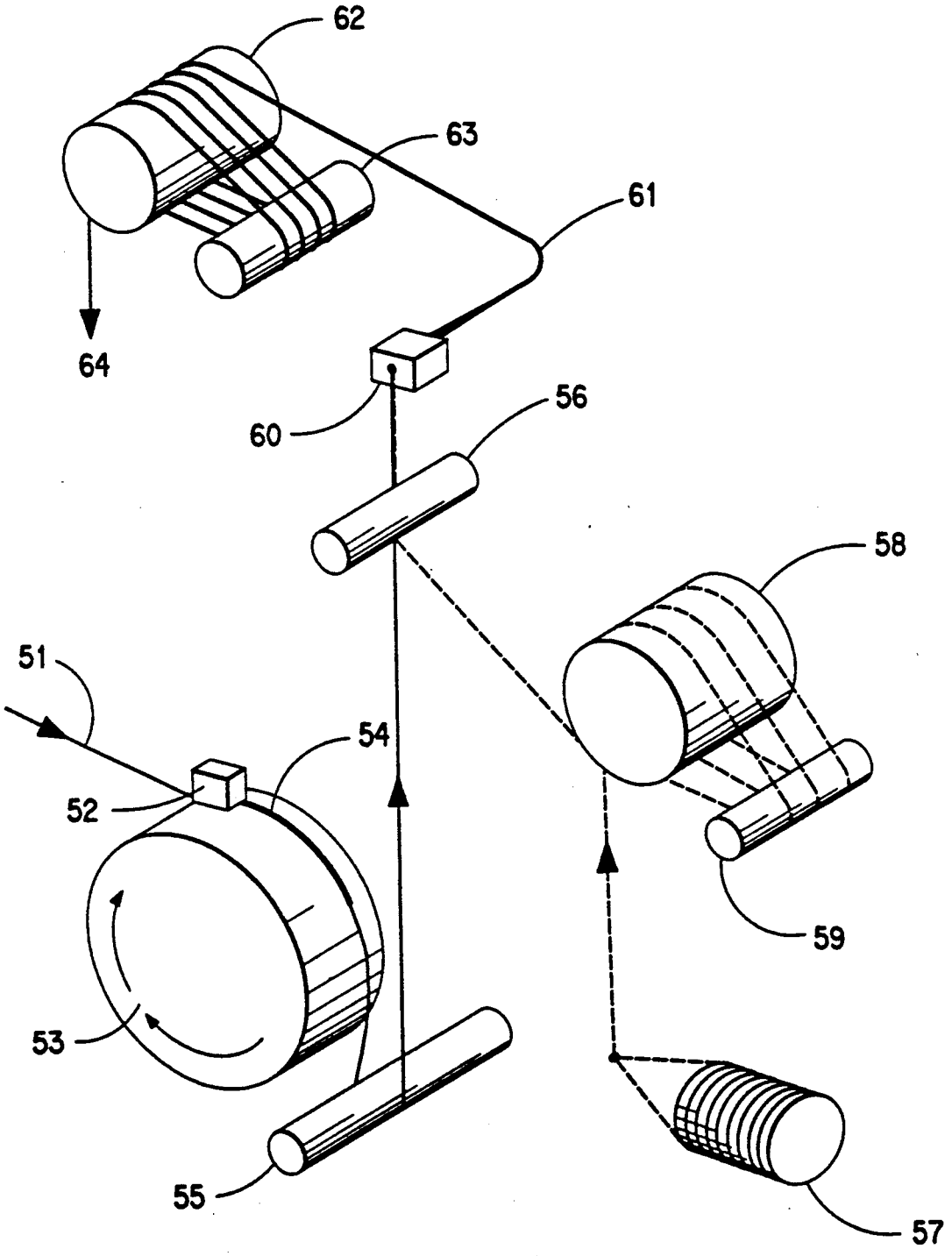
FIG. 3 is a schematic of a process in which the continuous filament base fiber and the low-melting binder filaments are interlaced without fixing the interlace.

This example demonstrates the need for using the rotating screened drum (or similar equipment to provide a tension-free state) following the dual-impingement jet in order to achieve acceptable interlace. The process is shown schematically in FIG. 3. Process conditions were identical to those used in Example 1 with continuous filament nylon 6,6 yarn 51 passing from the hot chest to single impingement jet 52, exiting to form a caterpillar 54 which was cooled on rotating screen drum 53, after which it passed around guide pin 55 to guide pin 56 where it was combined with low melting copolymer binder yarn 57, the speed and tension of which were controlled using auxiliary roll 58 and associated separator roll 59. In this example, however, the dual-impingement jet 60 was located outside of the bulking chest and had no screened drum associated with it so that the yarn formed a rooster tail 61 upon exiting jet 60 and before going to the take-up rolls 62 and 63 and on to wind-up 64. While the binder yarn exhibited no breaks and was continuous throughout the resulting BCF bundle, it was not well interlaced with the base yarn and formed loops which were easily separated from the base yarn filaments. The low degree of interlace is reflected in the APDC value of 13.2 cm.

I claim:

1. A continuous process for producing a bulked, interlaced composite yarn from a continuous filament yarn and a low-melting binder yarn comprising the sequential steps of:

a) bulking a freshly spun and drawn continuous filament yarn at a temperature greater than the melting point of the binder yarn;

b) combining the binder yarn with the bulked yarn to form a composite yarn;

c) interlacing the composite yarn at a temperature below the melting point of the binder yarn; and d) fixing the interlace of the composite yarn.

2. The process of claim 1 wherein the continuous filament yarn is made using a polymer selected from the group consisting of nylon 6,6, nylon 6, polyethylene terephthalate, and polypropylene.

3. The process of claim 2 wherein the low melting binder fiber is made using a random copolymer of the polymer from which the continuous fiber is made.

4. The process of claim 3 wherein the continuous filament yarn is made using nylon 6,6 and the low-melting binder fiber is a random copolymer of nylon 6 and nylon 6,6.

* * * * *